United States Patent [19]

Samhammer et al.

[11] 3,944,032

[45] Mar. 16, 1976

[54] LUGGAGE CASE CONSTRUCTION

[75] Inventors: Clair A. Samhammer, Laguna Beach; Arthur W. Ellsworth, Orange; James P. Sullivan, Tustin, all of Calif.; John A. Artmann; Robert A. Null, both of Denver, Colo.

[73] Assignee: Samsonite Corporation, Denver, Colo.

[22] Filed: Mar. 20, 1974

[21] Appl. No.: 452,756

[52] U.S. Cl. ..... 190/41 B; 190/41 Z; 190/51; 190/49

[51] Int. Cl.[2] ..... A45C 3/00

[58] Field of Search ..... D87/5 G; 190/41 B, 41 Z, 190/43, 49, 51

[56] References Cited

UNITED STATES PATENTS

| | | | |
|---|---|---|---|
| 2,087,211 | 7/1937 | Marbury | 190/41 Z |
| 2,109,141 | 2/1938 | Richter | 191/41 B |
| 2,157,833 | 5/1939 | Plotkin | 190/41 Z |
| 2,261,291 | 11/1941 | Salavsky | 190/41 Z |
| 2,606,636 | 8/1952 | Braverman | 190/43 |
| 3,139,164 | 6/1964 | Koffler | 190/43 |
| 3,139,165 | 6/1964 | Taussig | 190/41 Z |
| 3,164,231 | 1/1965 | Kryznoski | 190/43 |
| 3,175,658 | 3/1965 | Bierman | 190/43 |
| 3,273,678 | 9/1966 | Koret | 190/51 |
| 3,628,640 | 12/1971 | Molnar | 190/41 Z |

FOREIGN PATENTS OR APPLICATIONS

| | | | |
|---|---|---|---|
| 844,390 | 8/1960 | United Kingdom | 190/41 |
| 867,533 | 5/1961 | United Kingdom | 190/41 |

*Primary Examiner*—William Price
*Assistant Examiner*—Ro. E. Hart
*Attorney, Agent, or Firm*—George J. Netter

[57] ABSTRACT

A first relatively rigid case section having two end walls with a connecting intermediate wall is interconnected with a flexible second case section via a single zipper with stops defining permanent securement lengths. The first case section also includes a generally C-shaped frame contoured to form the upper wall and extend downwardly a limited amount onto each end wall. Molded plastic supports are affixed to the lower inner end portions of the end walls to provide a firm supportive base for the case. Case sections are otherwise formed of a pliant material, eg, laminated plastic sheets. A cover and strap or bar fold over long garments such as coats or dresses, holding them against the inner wall surfaces of the second case section. A hanger assembly affixed to the inner top wall surface accommodates garment hangers. Optionally, hooklike apparatus connected to the first case section is selectively extendible to the outside of the case to enable toting or hanging of the open case assembly. In yet another aspect, the outer side wall has a shallow pocket for carrying papers or the like which is accessible via a portion of the closure means. As yet another aspect, the zipper pulls each include a loop and slot construction such that when they are positioned immediately adjacent each other, they may be nested together with the slot of either receiving the loop of the other.

16 Claims, 13 Drawing Figures

FIG. 5.
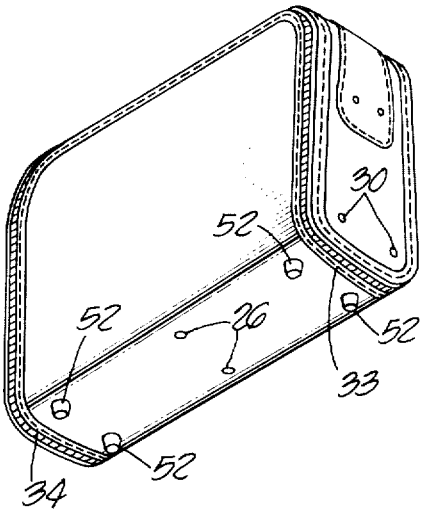
FIG. 3.
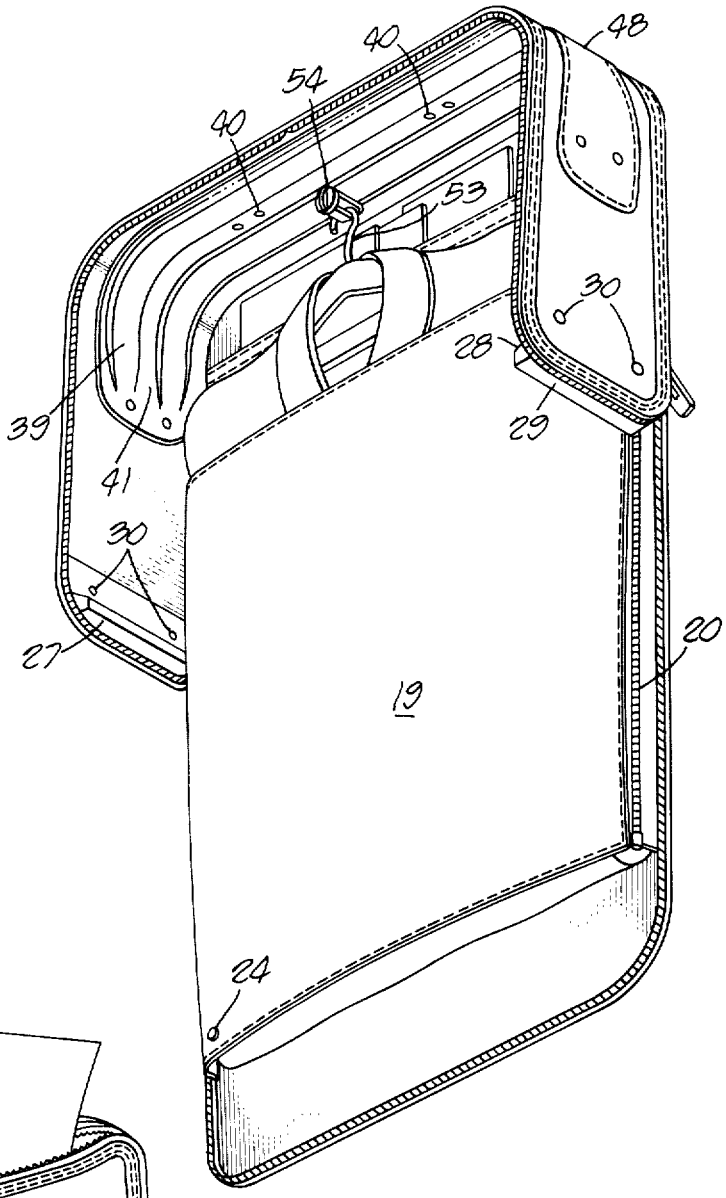
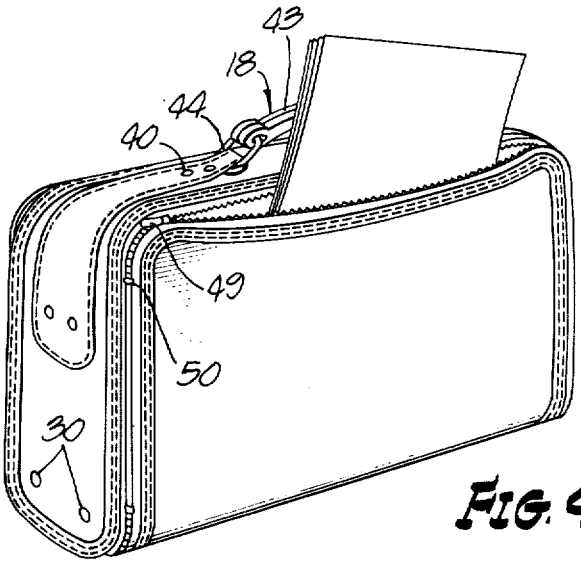
FIG. 4.

FIG. 9.
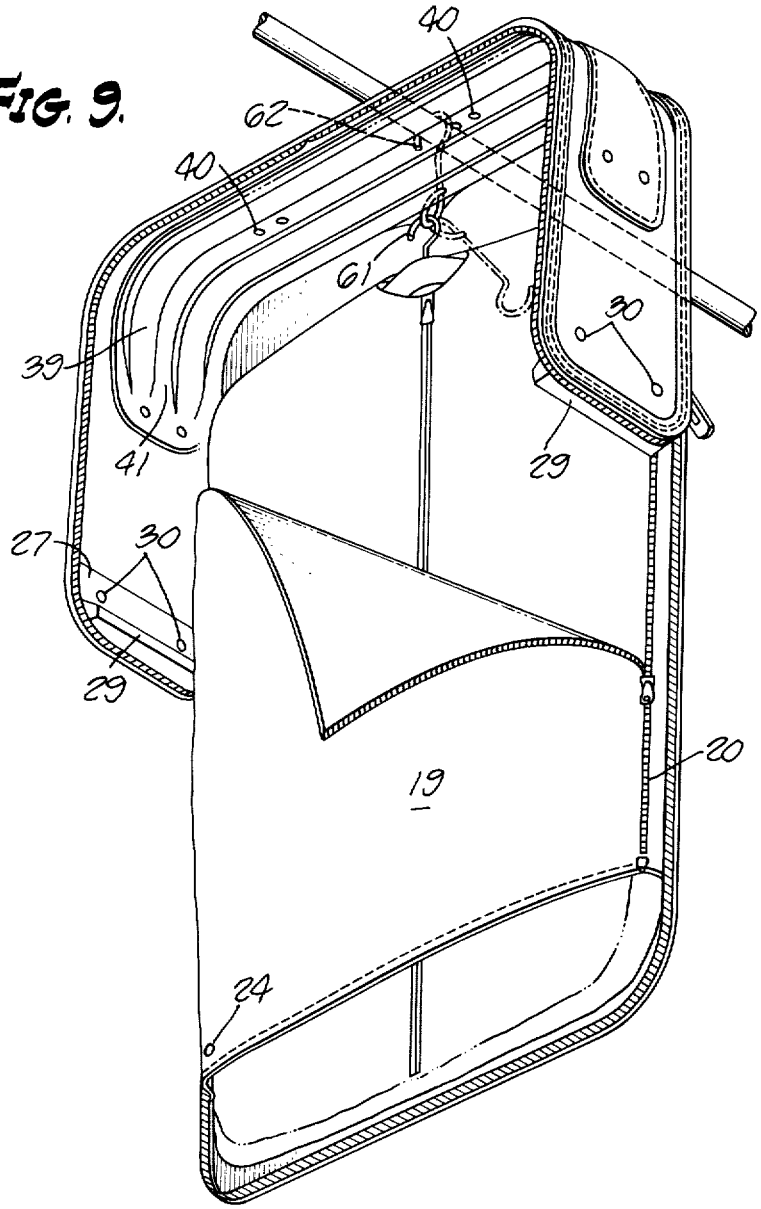
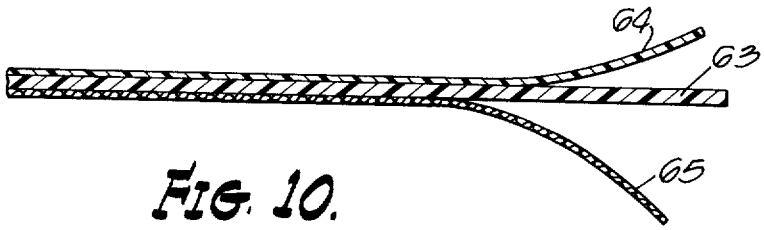
FIG. 10.

LUGGAGE CASE CONSTRUCTION

The present invention relates generally to a luggage case construction, and, more particularly, to such a luggage case construction which is readily opened to a condition permitting hanging, carrying or laying flat.

OBJECTS AND SUMMARY OF THE INVENTION

A primary object and aim of this invention is to provide an improved luggage case having two unitary case sections which are connected to one another at certain parts and separably joined at other parts, enabling ready break-out into extended, relatively flat condition.

Another object is the provision of a luggage case having a first relatively rigid case section wrappingly enclosed by a second flexible case section.

A further object is the provision of a luggage case having a compact assembled form for carrying and which is opened out into an elongated flat form for hanging, toting, or laying flat.

Another object of the invention is the provision of a luggage case as described in the above objects and having closure means dividing the luggage case generally into two sections, a portion of which closure means opens into a shallow pocket for carrying papers or the like.

Yet another object is the provision of a luggage case which can be opened into extended, relatively flat condition, and includes means selectively extendible from the case for hanging mode use.

A further object is the provision of a luggage case in which relatively long items of clothing (e.g., topcoat) are held within the case in such manner as to closely follow the internal case walls, thereby avoiding creasing or sharp folding of the garments.

Another object is the provision of a luggage case having an improved laminated wall construction.

Yet another object is the provision of a luggage case construction which is readily opened and closed for use, and simple and inexpensive to manufacture.

In the practice of this invention, there is provided a first relatively rigid case section having two end walls with a connecting intermediate wall, and a flexible second case section with front and back walls and an interconnecting lower wall. The two case sections are joined via closure means which, when closed, separably maintain the second section wrappingly enclosing the first section. When the closure means are released, the second case section partially unfolds from the first and extends into a relatively flat condition. The first case section also includes a generally C-shaped frame contoured to form the upper wall and extend downwardly a limited amount onto each end wall. Also, the walls of both case sections are formed from a pliant material. Molded plastic supports are affixed to the lower inner end portions of the end walls to provide a firm supportive base for the case.

The closure means preferably includes a single zipper interrelating the opposed edges of the case sections with stops defining extents of permanent securement.

The inner walls of the flexible second case section include a cover and strap or bar for folding over long garments such as coats or dresses to hold them against the inner wall surfaces. A hanger assembly affixed to the inner top wall surface accommodates garment hangers.

In a further aspect, hooklike apparatus connected to the first case section is selectively extendible to the outside of the case to enable toting or hanging of the opened case assembly, whereby suits, coats and the like contained therein can extend downwardly in a natural condition. In yet another aspect, the outer side wall has a shallow pocket for carrying papers or the like which is accessible via a portion of the closure means.

The preferred material from which the case side walls are constructed is a multiple layer laminate. Specifically, an extrudable thermoplastic substrate is laminated with a thermoplastic sheet having a thickness and an external design dependent upon end use requirements. Lamination is accomplished through application of pressure and heat, and, optionally, with the additional use of adhesives. Even more preferred is to include as a third lamination on the opposite side of the substrate a thermoplastic film, or woven or non-woven fabric which serves as the case liner.

As yet another aspect, the zipper pulls each include a loop and slot construction such that when they are positioned immediately adjacent each other, they may be nested together with the slot of either receiving the loop of the other. When so nested a conventional lock may be inserted through the loop.

DESCRIPTION OF THE DRAWINGS

FIG. 3 depicts the luggage case in the fully open position.

FIG. 4 is a perspective of the back side of the luggage case from that illustrated in FIG. 1, showing a zipper access storage pocket.

FIG. 5 is a perspective view of the luggage case from the bottom.

FIG. 9 depicts an alternate garment hanging apparatus.

FIG. 10 is an exploded view of multilayered case wall construction.

DESCRIPTION OF PREFERRED EMBODIMENTS

Figure 1:
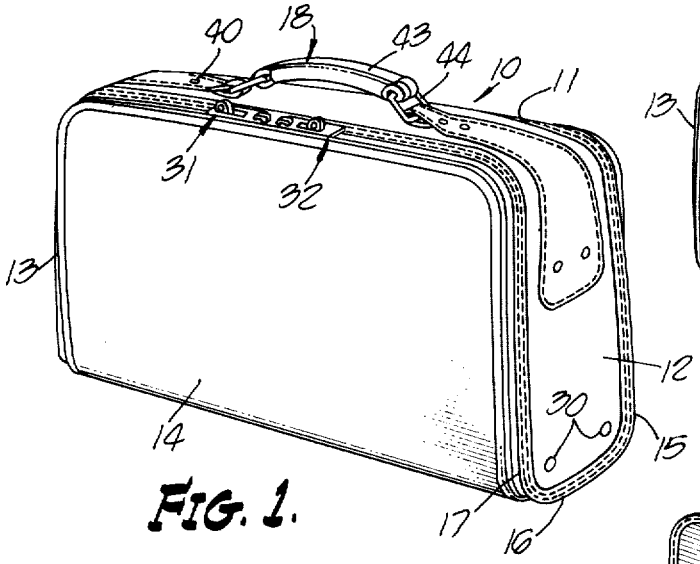
FIG. 1 shows a perspective view of one form of the luggage case of this invention.

With reference now to the drawings and particularly FIG. 1, the luggage case embodying the present invention is enumerated generally as at 10. As shown there, the case includes a top panel 11 and a pair of end panels 12 and 13 joined together and forming a first integral case section. A front side panel 14, back side panel 15 and bottom panel 16 are integrally related, forming a second case section which is separably connected to the panels 11–13 of the first case section by a suitable closure means such as a zipper 17, for example. More particularly, the panels 11, 12 and 13, by virtue of a construction to be described, is relatively rigid, maintaining an overall C-shape and the panels 14–16 wrappingly engage the panels 11–13 to enclose storage space therewithin when in closed condition. In the described embodiment, the panels 14–16 are constructed of a suitable sheetlike material, and preferably of a flexible multiple layered laminate. A handle assembly 18, also to be described in detail later, is secured to the top and side walls 11–13.

Figure 2:
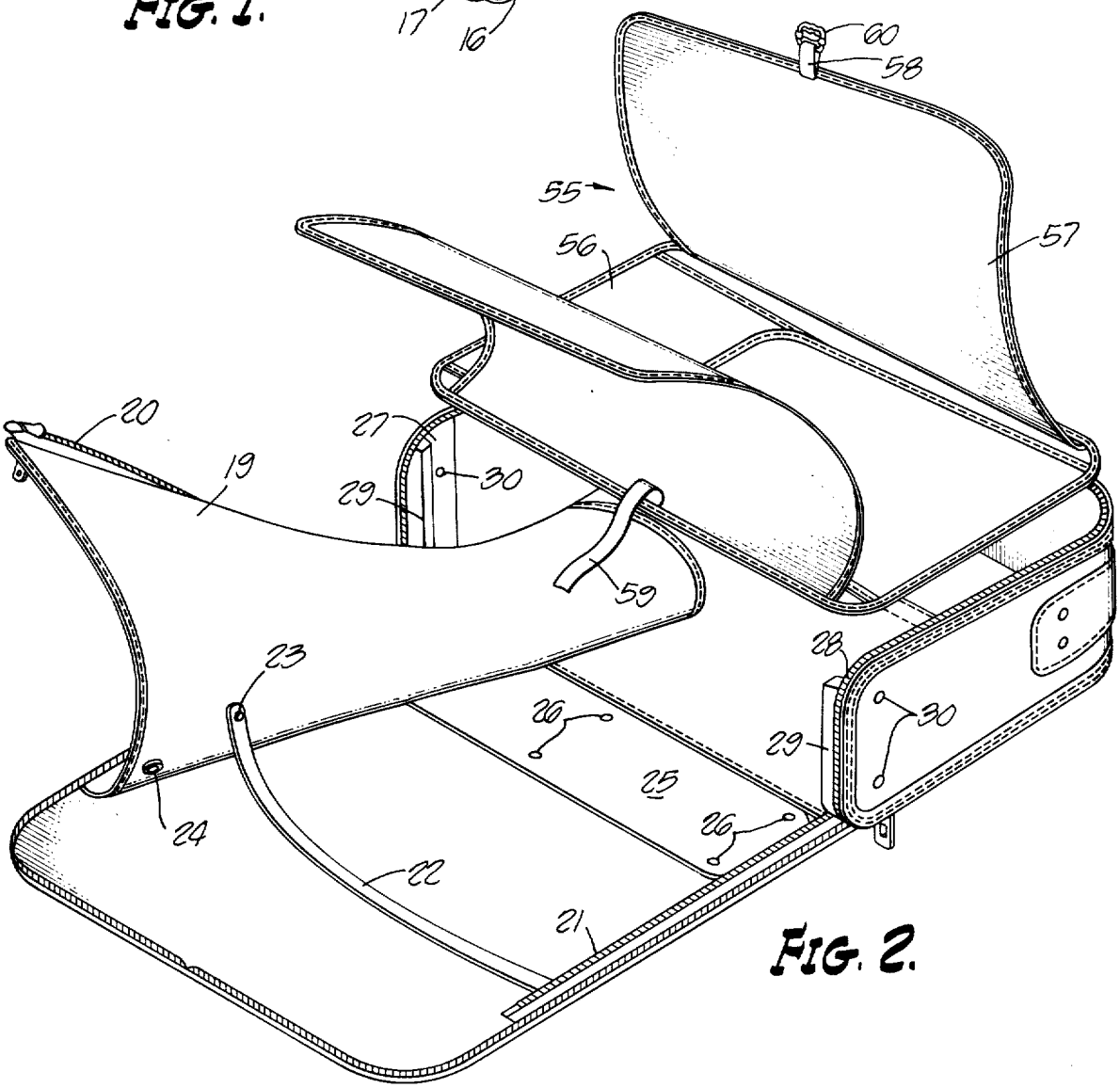
FIG. 2 shows the luggage case in the open position with an organizer raised from the main storage area.

Turning now to FIG. 2, the luggage case 10 is shown in open condition with the zipper 17 released and front bottom panels 14 and 16 separated or unwrapped from the rigid C-shaped shell formed by panels 11–13. A rectangular sheet 19 of a flexible material, such as a woven or non-woven fabric, has one side affixed along a common side edge of panels 14 and 16 immediately adjacent the zipper 17. The opposite side of sheet 19 includes further closure means such as a zipper 20 for cooperating with a zipper 21 arranged along and inwardly directed from the opposite side edge of panels 14 and 16. A strap 22 has one end secured to panel 14 underneath the zipper 21 adjacent the outer end thereof and a snap 23 on its other end for removable securement to a mating snap part 24 on the inner surface of the fabric sheet 19. In a manner that will be set forth in detail later herein, relatively long apparel such as coats and dresses, for example, are laid directly onto the inner surfaces of the panels 14–16, the strap is placed thereover and the snaps 23 and 24 connected, following which the sheet 19 is arranged over the apparel and strap and the zippers 20 and 21 joined together.

A generally rectangular plate 25, constructed of a rigid material, such as a plastic or metal sheet, for example, is affixed to the inner surface of the bottom wall 16 by rivets 26. The plate has substantially the same dimensions as the bottom wall 16 and has sufficient thickness to provide a firm base for the luggage case.

The lower inside marginal edges of the end walls or panels 12 and 13 are provided with reinforcing means 27 and 28. These serve the multiple purposes of providing firm base corners for supporting the case when it is in the usual bottom panel down orientation of FIG. 1, and also that of maintaining lower edge structural integrity when the case is dropped or slid along the floor.

Figure 7:
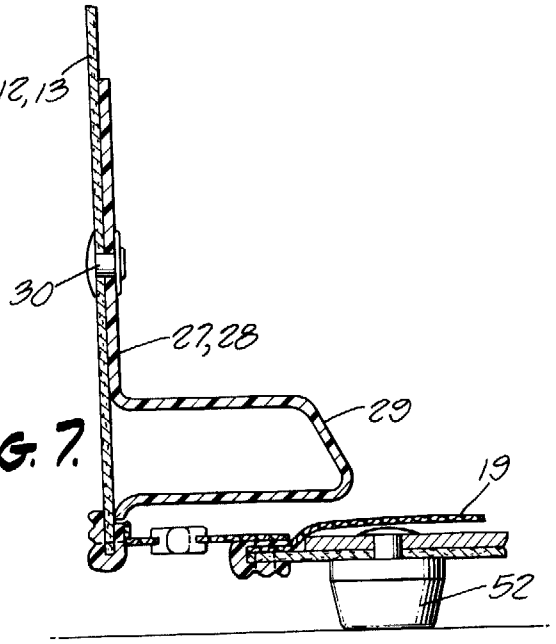
FIG. 7 is a fragmentary, sectional elevational view through the luggage case corner reinforcement.

As shown best in FIG. 7, a preferred form of the reinforcing means 27 and 28 is that of a hollow, thin-wall plastic construction, generally L-shaped in section as viewed parallel to panels 12 and 13 and with a double walled base 29 which extends away and inwardly of the case from the end wall 12 or 13, as the case may be. The reinforcing means are located closely adjacent the lower end of the associated end panel with the base spaced slightly from the bottom panel. As viewed normal to the plane of panels 12 and 13, the reinforcing means is generally rectangular, with radiused lower corners. Securement of the reinforcing means to the end panels may be accomplished by rivets 30, for example.

Figure 8A:
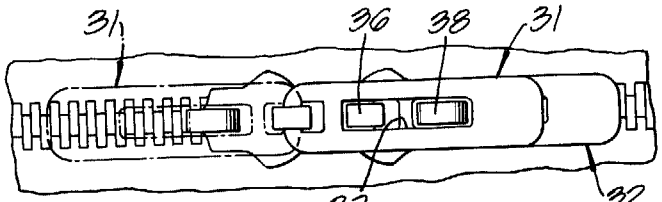
FIG. 8a is a plan view of the zipper pulls shown in overlapping relation for locking.
Figure 8:
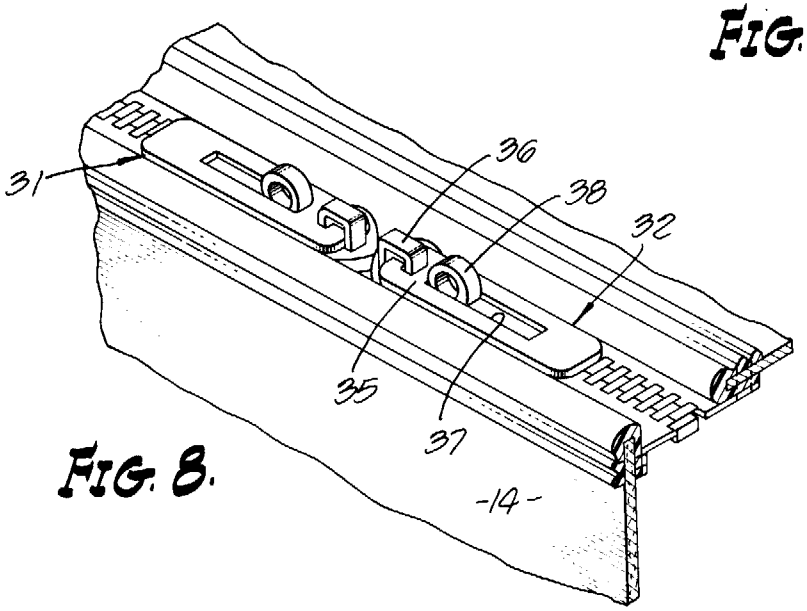
FIG. 8 is a perspective, fragmentary view of the zipper pulls for the luggage.
Figure 6A:
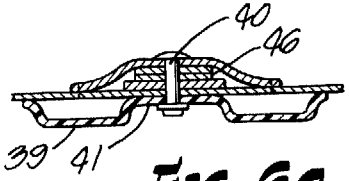
FIG. 6*a* is a sectional, elevational view of the handle assembly taken along the line 6*a*—6*a* of FIG. 6.

The closure means 17 preferably comprises a single zipper interconnecting the full length of edges of panels 14–16 to the corresponding edges of 11–13. As shown in FIGS. 8 and 8a, a pair of zipper pulls or actuators 31 and 32 are provided for opening and closing the zipper 17, with zipper stops located at 33 and 34 limiting the degree of opening of panels 14–16 with respect to luggage case section 18. Each zipper pull comprises a tab 35 rotatably connected as at 36 for pivotal movement in a plane including the zipper line. An elongated slot

37 in the tab receives an upstanding locking loop 38 therethrough. When the two zipper pulls are located next to one another, the tab of either may be pivoted such that its slot is received onto the locking of the other, as shown best in FIG. 8a. When in this latter orientation, a conventional lock (not shown) may be inserted through the locking loop for securement.

As depicted in FIG. 3, the C-shaped luggage case section includes a stiffener or reinforcing frame 39 secured to the inner surface of the top and end panels 11–13 by rivets 40, for example. More particularly, the frame is an injection molded plastic sheet having a width slightly less than that of panels 11–13. Also, the frame is contoured to have substantial corner radii closely conforming to those of the top panel end portions and is otherwise shaped and of a length to extend completely along the top wall 11 and part way down onto the end panels 12 and 13. Optionally, one or more longitudinally extending strengthening ribs may be provided.

Figure 6:
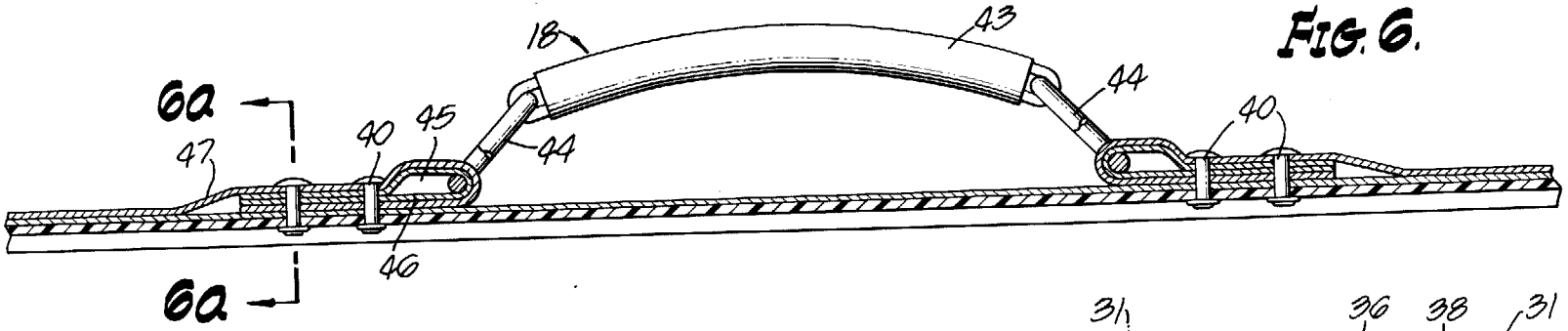
FIG. 6 is a partially sectional, elevation of the case handle assembly.

Reference is now made to FIG. 6 and the detailed construction of the luggage case handle assembly identified generally as at 42. Specifically, the assembly includes an elongated grip 43, each end of which is pivotally connected to a metal link or loop 44. Each loop is also pivotally received within an opening 45 of a folded-over metal part 46. A straplike element 47 has a relatively narrow end which is wrapped around each metal part 46 with the composite layered structures so formed being secured to the top panel 11 via the rivets 40 that hold the frame 39 to the case panels (FIG. 3). The straplike element extends along the top panel 11 and downwardly on the side panels 12 or 13, as the case may be, terminating at a point lying substantially opposite the associated end of the frame 39. These straps gradually widen out from the narrow end adjacent the handle to a maximum width at their other end with securement to the luggage case end panels 12 and 13 being provided by rivets 20 and lines of stitching 48 arranged along the element margins.

From the described luggage case handle assembly construction and manner of affixing to the case walls, it can be seen that the carrying load of the case and its contents is transmitted along the handle 43, loops 44, folded metal parts 46, straplike elements 47 and rivets 40, directly to the underlying frame 39. That is, from a structural standpoint, the primary loading is borne by the frame 39 with loading interconnection to the strap and handle means being effected via the rivets in the top panels.

In another feature of the invention, a shallow side pocket is incorporated into the back side panel 15 as shown best in FIG. 4. This pocket can be used for business papers, magazines, umbrellas or other small objects which it may be desired to retrieve during travel, for example, without disturbing the packed clothing. More particularly, that portion of the zipper 17 which extends along the opposed edges of the top panel 11 and back panel 15 serves as access means for the side pocket and is under control of a zipper pull 49 operating between stops 50 and 51. A fabric liner (not shown) extending along the inner surface of 15 defines the pocket.

As depicted in FIG. 5, the outer surface of the bottom panel 16 includes four feet 52 for supporting the case in its usual resting mode. Specifically, these feet may be constructed of a durable, abrasive-resistant plastic and riveted through the bottom wall 16 to the underlying plate 25.

For the ensuing description of the packing of relatively long apparel such as coats, suits and dresses, reference is made simultaneously to FIGS. 2 and 3. With the fabric sheet 19 folded back and the strap 22 unsnapped, the apparel is arranged to lie flat against the inner surfaces of the side and bottom panels 14–16. When the apparel is carried on a hanger, the hanger hook 53 is received onto a suitable mount 54 secured to the underside of frame 39. Next, the strap 22 is pulled across the apparel and the snaps 23 and 24 engaged. Finally, the fabric sheet 19 is stretched over the strap and apparel, and the zippers 20 and 21 joined. As shown best in FIG. 3, the long items of clothing are now integrally secured to the front, back and bottom walls 14–16, such that on closing the luggage, i.e., closing the zipper 17, the clothing is folded in the region of the bottom panel in a substantial radius, thereby reducing any tendency to wrinkle or crease. In addition, by holding the larger clothing items against the case walls, there is accordingly provided a central unobstructed space within which other items may be stored, such as shoes, toiletry items, shaving equipment, or the like.

An organizer for holding a number of small items together is enumerated generally as at 55 in FIG. 2. Specifically, the organizer includes a relatively stiff, rectangular platelike base 56 having flexible sheetlike covers or flaps 57 affixed to the base edges which are folded onto one another in overlapping relation. A pair of straps 58 and 59 and a buckle or clasp 60 serves to removably secure the flaps about the included items. The organizer is so dimensioned as to enable receipt within the luggage case central space after suits, dresses or other long apparel has been received therein in the manner described.

For an alternate form of the invention, reference is made to FIG. 9. As shown there, instead of the hanger mount 54, there is provided a loop 61 affixed to the frame 39 and onto which hanger hooks may be hung. In addition, a hook 62, similar to a hanger hook, is selectively removable through the rear pocket access opening for hanging support from an externally located rod 63 in a closet or the like. Optionally, the hook 61 and loop 62 may be a single integral construction (FIG. 9).

As already alluded to, the various luggage case panels are preferably of a multiple-layered lamination construction. For example, and with reference now to FIG. 10, the laminate substrate 63 is a sheet of an extrudable thermoplastic, such as the polyolefins including homopolymers, copolymers or impact-modified blends thereof. The outside layer 64, which is usually decoratively figured, is constructed of a supported expanded thermoplastic, such as vinyl or polyurethane. Although not essential, it is especially preferred that a third layer 65 be provided as a substitute for the separate fabric "liner" to be found in most prior art luggase cases. This liner layer may be formed from a plastic film or woven or non-woven fabric as desired. The multiple layer laminate is obtained by the simultaneous application of heat and pressure, and, where the specific materials used require it, with the additional use of a cementitious material.

Figure 11:
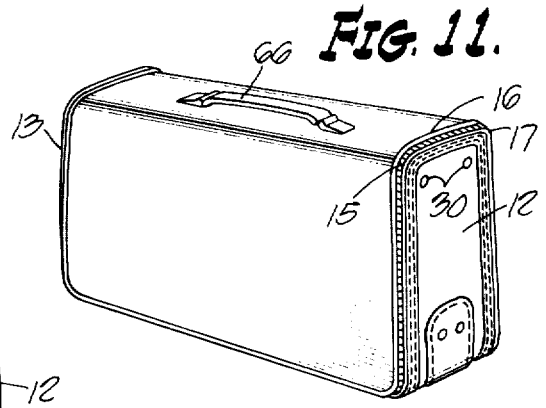
FIG. 11 depicts an alternate form of the luggage case of FIG. 1.

As described hereinabove, the luggage case 10 has included a relatively rigid C-shaped case section wrappingly enclosed by a second flexible case section with the handle assembly 18 affixed to the rigid case section. That is, on carrying by the handle, the top wall immediately under the handle is part of the rigid or C-shaped case section. It is contemplated, however, that the entire case may be inverted with the lower panel 16 now being at the top and to which a handle 66 may be affixed, as shown in FIG. 11. Otherwise the case can be constructed in the manner and of the materials described in connection with the FIG. 1 embodiment.

We claim:

1. A luggage case, comprising:

a rigid C-shaped member including an elongated top panel and a pair of relatively short end panels extending at substantially ninety degrees from the respective ends of said top panel;

a flexible sheetlike member wrappingly enclosing the open sides of said C-shaped member having peripheral edges which are coextensive with the C-shaped member peripheral edges; and zipper closure means extending continuously along said sheetlike member peripheral edges in a close path and continuously along the peripheral edges of said C-shaped member, said zipper means coacting for releasably securing said flexible sheetlike member to said rigid one-piece member.

2. A luggage case as in claim 1, in which apparel retaining means are releasably affixed to the inner surface of said flexible sheetlike member and substantially coextensive therewith for folding therewith when said flexible sheetlike member is wrappingly secured to said C-shaped member.

3. A luggage case in claim 1, in which an outside portion of said flexible sheetlike member defines a shallow pocket, and zipper pull means operating on a given portion of said closure means to provide a selectively closable access to said pocket.

4. A luggage case in claim 1, in which there is further provided a C-shaped frame fittingly received within said C-shaped member and affixed thereto.

5. A luggage case in claim 1, in which there is further provided a C-shaped frame dimensioned and contoured for fitting receipt within said C-shaped member; means affixing said C-shaped member to said C-shaped frame; and handle means interconnected with said frame.

6. A luggage case construction, comprising;

a first relatively rigid shell-like case section including an elongated flat top panel and integral end portions extending away from said top panel in the same direction to form end panels for the case, said case section having two open sides and an open bottom;

a flexible sheetlike member of geometry and dimensions sufficient to enclose the open shell sides and bottom, forming a second case section, said member having edges coextensive with corresponding edges of the shell-like case section;

a rigid plate affixed to said flexible member forming a reinforced bottom for said case;

closure means releasably interconnecting the first and second case sections along the entire opposed edges thereof; and means for releasably holding apparel against the inner surface of said second case section enclosing a central storage space in said luggage case, said apparel holding means including a fabric member for extending over said apparel, affixed along an edge to said second case section and releasably secured to said second case section along another edge.

7. A luggage case construction, comprising:

a first case section defining the case end and intermediate panels;

a second case section wrappingly engaging said first case section defining the remaining case panels; and a single zipper continuously joining said first and second case section edges throughout and including at least a pair of zipper stops defining certain lengths of said zipper which are releasably joined together and certain other lengths which are permanently joined together; and said first and second case section panels being multilayered laminates.

8. A luggage case construction as in claim 7, in which said multi-layered laminates include a thermoplastic substrate, a decorative plastic outer layer and an inner liner, said layers being bonded to said substrate to form a unitary laminate construction.

9. A luggage case, comprising:

a rigid C-shaped frame;

first flexible sheetlike means received onto said frame and affixed thereto, forming a generally C-shaped first case section including a first flat panel and integral end portions extending away therefrom in the same direction as end panels, said first case section having three open sides;

second flexible sheetlike means wrappingly enclosing the open sides of said first case section to form a second case section, the dimensions and geometry of said second case section being such that the edges of said case sections can be made coextensive; and a single zipper continuously interconnecting the coextensive edges of said case sections to one another througout the entire length of said edges.

10. A luggage case, as in claim 9, in which there are further provided reinforcing means affixed to the inwardly facing end portions of said end panels.

11. A luggage case as in claim 9, in which said zipper includes a pair of zipper pulls, said pulls being nestable with each other, and having common means via which said pulls may be locked together to prevent release of said zipper.

12. A luggage case as in claim 11, in which said zipper pulls each include a rotatable tab with a slot therein and an upstanding loop, each said tab being rotatable to receive the loop of the other zipper pull through its slot, with locking being effect via the said loop.

13. A luggage case, comprising:

a generally rectangular, rigid, sheetlike member formed about transverse axes in the plane of said member to form a rigid C-shaped frame;

first laminated flexible sheetlike means conformingly received onto said frame and affixed thereto, forming a generally C-shaped first case section including a top panel, integral end panels extending away therefrom in the same direction, and having three open sides;

second laminated flexible sheetlike means wrappingly enclosing the open sides of said first case section to form a second case section, the dimensions and geometry of said second case section being such that the edges of said case sections are coextensive; and a single zipper continuously interconnecting the opposed coextensive edges of said case sections to one another throughout the full length of said edges.

14. A luggage case, as in claim 13, in which there are further provided reinforcing means affixed to the inwardly facing end portions of each of said end panels and spaced from said frame.

15. A luggage case as in claim 13, in which said zipper includes at least two stops defining closed lengths of said zipper, and a pair of zipper pulls, said pulls being nestable with each other and having common means via which said pulls may be locked together to prevent release of said zipper.

16. A luggage case as in claim 15, in which said zipper pulls each includes a pivotable tab with a slot therein and an upstanding loop, each said tab being rotatable to receive the loop of the other zipper pull through its slot, with locking being effected via the said loop.

* * * * *